US012797706B2

(12) United States Patent
Buckley

(10) Patent No.: US 12,797,706 B2
(45) Date of Patent: Nov. 17, 2026

(54) TRAINING DEVICE FOR SNOWBOARD, TRAINER SNOWBOARD WITH TRAINING DEVICE, AND KIT OF PARTS FOR ASSEMBLING TRAINING DEVICE

(71) Applicant: Daniel Buckley, Portland, ME (US)

(72) Inventor: Daniel Buckley, Portland, ME (US)

( * ) Notice: Subject to any disclaimer, the term of this patent is extended or adjusted under 35 U.S.C. 154(b) by 126 days.

(21) Appl. No.: 18/970,222

(22) Filed: Dec. 5, 2024

(65) Prior Publication Data

US 2025/0177834 A1 Jun. 5, 2025

Related U.S. Application Data

(60) Provisional application No. 63/606,293, filed on Dec. 5, 2023.

(51) Int. Cl.
*A63B 69/00* (2006.01)

(52) U.S. Cl.
CPC .... *A63B 69/0093* (2013.01); *A63B 2225/093* (2013.01)

(58) Field of Classification Search
CPC ..... A63B 69/0093; A63B 2225/09; A63B 2225/093; A63C 17/01; A63C 17/265; A63C 5/03; A63C 5/06
See application file for complete search history.

(56) References Cited

U.S. PATENT DOCUMENTS 4,179,134 A * 12/1979 Atkinson ..... A63C 17/01 188/29
6,199,880 B1 * 3/2001 Favorito ..... A63C 17/01 280/14.28
2004/0171463 A1 * 9/2004 Rozycki ..... A63B 69/0093 482/71
2010/0276912 A1 * 11/2010 Lange ..... A63C 17/26 280/727

OTHER PUBLICATIONS

Absolute Board Co.; Webpage: 'How to Use Your Ookkie'; URL: https://www.ookkie.com/pages/how-to-use-your-ookkie (2026); Entire Article.

* cited by examiner

*Primary Examiner* — Jerry-Daryl Fletcher
(74) *Attorney, Agent, or Firm* — Grogan, Tuccillo & Vanderleeden LLP

(57) ABSTRACT

A snowboard trainer includes a base plate for mounting on a board. The base plate has a handle support assembly configured to secure at least one handle assembly thereto. The handle support assembly includes a first flange structure and a second flange structure. A height-adjustable guide handle assembly removably attachable with the first flange structure allows a guide to control speed and direction of the sliding board while operated by a rider. A location of attachment of the guide handle assembly with the first flange structure creates a fulcrum point for the guide handle assembly to rotate thereabout while the guide controls the speed and the direction of the sliding board to provide a free-flowing ride to the rider. A height-adjustable rider handle assembly removably attachable with the second flange structure is configured to be held by the rider for balance while supported on the sliding board.

9 Claims, 9 Drawing Sheets

TRAINING DEVICE FOR SNOWBOARD, TRAINER SNOWBOARD WITH TRAINING DEVICE, AND KIT OF PARTS FOR ASSEMBLING TRAINING DEVICE

CROSS-REFERENCE TO RELATED APPLICATION

This application claims the benefit of U.S. Provisional Application Ser. No. 63/606,293, filed on Dec. 5, 2023, which is hereby incorporated by reference herein in its entirety.

BACKGROUND

Embodiments of this disclosure relate generally to boardsports, and more specifically, to a snowboard having a training device integrated therewith to form a trainer snowboard that assists beginner snowboard riders in learning how to snowboard and improve their skills more quickly and safely by promoting stability, balance and guidance to riders.

Currently, most snowboard instructors walk or snowboard along the side of a beginner rider attempting to physically hold the beginner up in order to teach them the balance needed to control the snowboard. This typically results in the beginner rider and sometimes both the beginner and the instructor falling many times until stability and balance are learned. This method of instruction can be difficult since the instructor must run or snowboard after the beginner rider to catch up when the beginner starts moving on their own. This method of instruction is flawed in that the instructor is attempting to control the snowboard by means of holding onto the body of the beginner rider. As a result, it is difficult for a beginner rider to improve their stability, balance and overall feeling of secureness on a snowboard. Without improvement in a beginner rider's stability, balance and overall feeling of secureness, it is difficult for the rider to improve his or her skills more quickly and thus undermines their ability to become a more independent rider.

BRIEF SUMMARY

The following presents a simplified summary of the disclosed subject matter in order to provide a basic understanding of some aspects of the various embodiments described herein. This summary is not an extensive overview of the various embodiments. It is not intended to exclusively identify key features or essential features of the claimed subject matter set forth in the Claims, nor is it intended as an aid in determining the scope of the claimed subject matter. Its sole purpose is to present some concepts of the disclosure in a streamlined form as a prelude to the more detailed description that is presented later.

The various embodiments address the problems with instructing beginner snowboard riders with a training device that assist snowboarders in improving their skills more quickly and safely. The training device of the various embodiments focuses on providing stability, balance, and guidance to riders as they learn. As a result, the training device gradually allows riders to become more independent as their skills progress.

In accordance with one embodiment, a boardsport training device for use with a sliding board is provided. The boardsport training device of this embodiment includes a base plate adapted for mounting on an upper surface of the sliding board, the base plate having a handle support assembly configured to secure at least one handle assembly thereto, wherein the handle support assembly includes a first flange structure and a second flange structure adjacent the first flange structure; a height-adjustable guide handle assembly removably attachable with the first flange structure that allows a guide to control speed and direction of the sliding board while operated by a rider, wherein a location of attachment of the guide handle assembly with the first flange structure creates a fulcrum point for the guide handle assembly to rotate thereabout while the guide controls the speed and the direction of the sliding board to provide a free-flowing ride to the rider; and a height-adjustable rider handle assembly removably attachable with the second flange structure configured to be held by the rider for balance while supported on the sliding board including instances when guided by the guide and instances without any assistance from the guide.

In accordance with another embodiment, a trainer snowboard is provided. The trainer snowboard of this embodiment includes an elongated board having a first end, a second end, a top and a bottom, a left side periphery and a right side periphery, the elongated board having a longitudinal axis between its first and second ends, the board being generally straight along a majority of its longitudinal axis between the first and second ends, the board top having a surface on which a rider may stand between the first and second ends, and the board bottom being a low-friction surface for sliding on a snowy surface; a base plate adapted for mounting on the surface of the board top about the first end, the base plate having a handle support assembly configured to secure at least one handle assembly thereto, wherein the handle support assembly includes a first flange structure and a second flange structure adjacent the first flange structure; a height-adjustable guide handle assembly removably attachable with the first flange structure that allows a guide to control speed and direction of the board while operated by the rider, wherein a location of attachment of the guide handle assembly with the first flange structure creates a fulcrum point for the guide handle assembly to rotate thereabout while the guide controls the speed and the direction of the board to provide a free-flowing ride to the rider over flat surface and through surfaces with elevation changes, allowing the rider to have edge control of the board over varying surfaces at the left side periphery and the right side periphery; and a height-adjustable rider handle assembly removably attachable with the second flange structure configured to be held by the rider for balance while supported on the board including instances when guided by the guide and instances without any assistance from the guide.

In accordance with third embodiment, a kit of parts for a trainer snowboard is provided. The kit of parts in this embodiment includes a base plate adapted for mounting on a top surface of a snowboard, the base plate having a handle support assembly configured to secure at least one handle assembly thereto, wherein the handle support assembly includes a first flange structure and a second flange structure adjacent the first flange structure; a height-adjustable guide handle assembly removably attachable with the first flange structure that allows a guide to control speed and direction of the snowboard while operated by a rider, wherein a location of attachment of the guide handle assembly with the first flange structure creates a fulcrum point for the guide handle assembly to rotate thereabout while the guide controls the speed and the direction of the snowboard to provide a free-flowing ride to the rider through elevation changes, allowing the rider to have edge control of the snowboard; and a height-adjustable rider handle assembly removably attachable with the second flange structure configured to be held by the rider for balance while supported on the snowboard including instances when guided by the guide and instances without any assistance from the guide.

BRIEF DESCRIPTION OF THE DRAWINGS

The present invention will be better understood from reading the following description of non-limiting embodiments, with reference to the attached drawings, wherein below.

DETAILED DESCRIPTION

Example embodiments of the present invention will be described more fully hereinafter with reference to the accompanying drawings, in which some, but not all embodiments are shown. Indeed, the present invention may be embodied in many different forms and should not be construed as limited to the embodiments set forth herein; rather, these embodiments are provided so that this disclosure will satisfy applicable legal requirements. For like numbers may refer to like elements throughout.

This disclosure relates generally to a training device for use with boardsports. Although the description that follows is directed to a training device for a snowboard, it is understood that the various embodiments of the training device have applicability with a number of different boardsports. For example, the embodiments of the training device described herein can have applicability with skateboards, scooter boards, skimboards, surf boards and the like.

Figure 1:
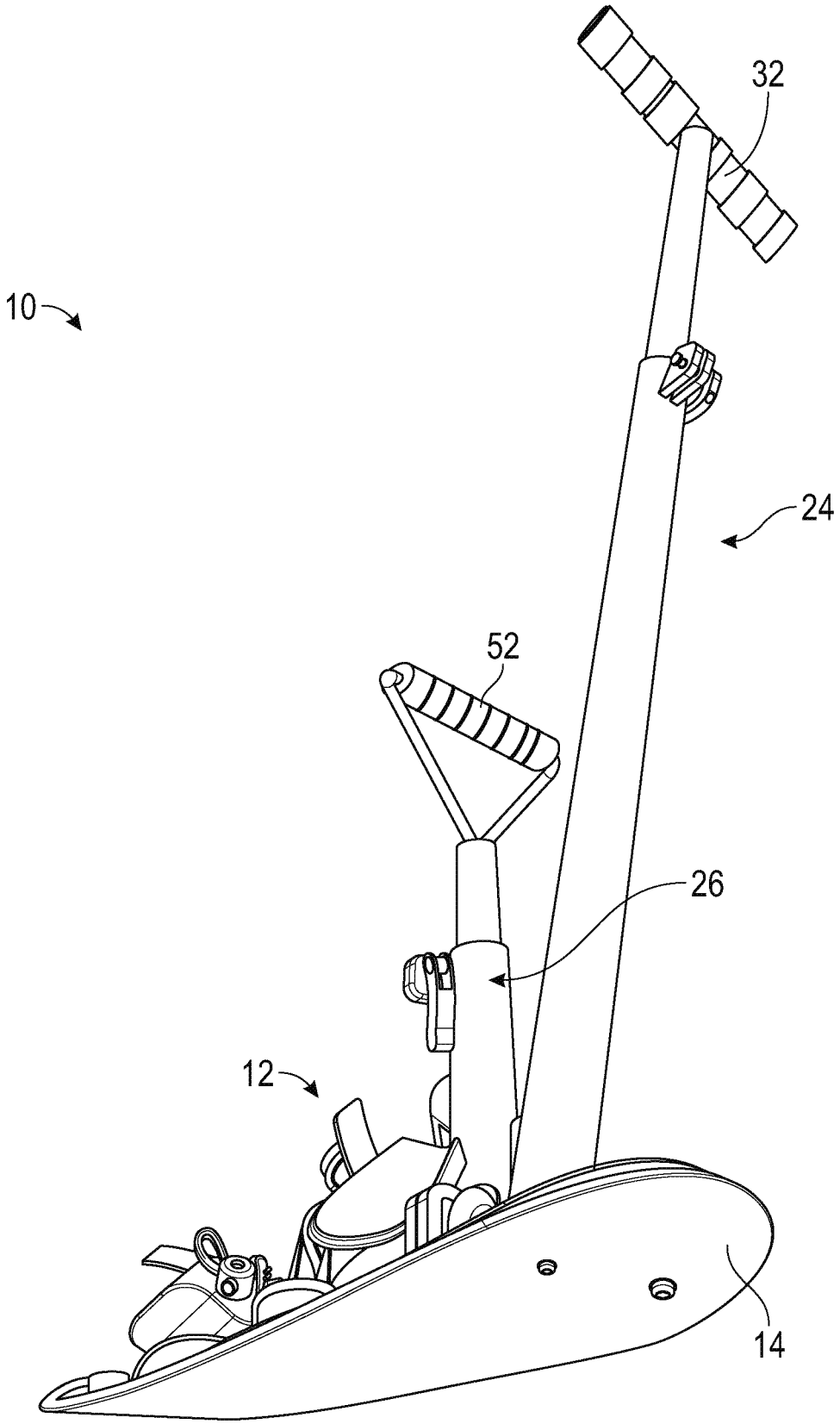
FIG. 1 is a perspective view of a trainer snowboard with a training device according to an embodiment of the invention.
Figure 2:
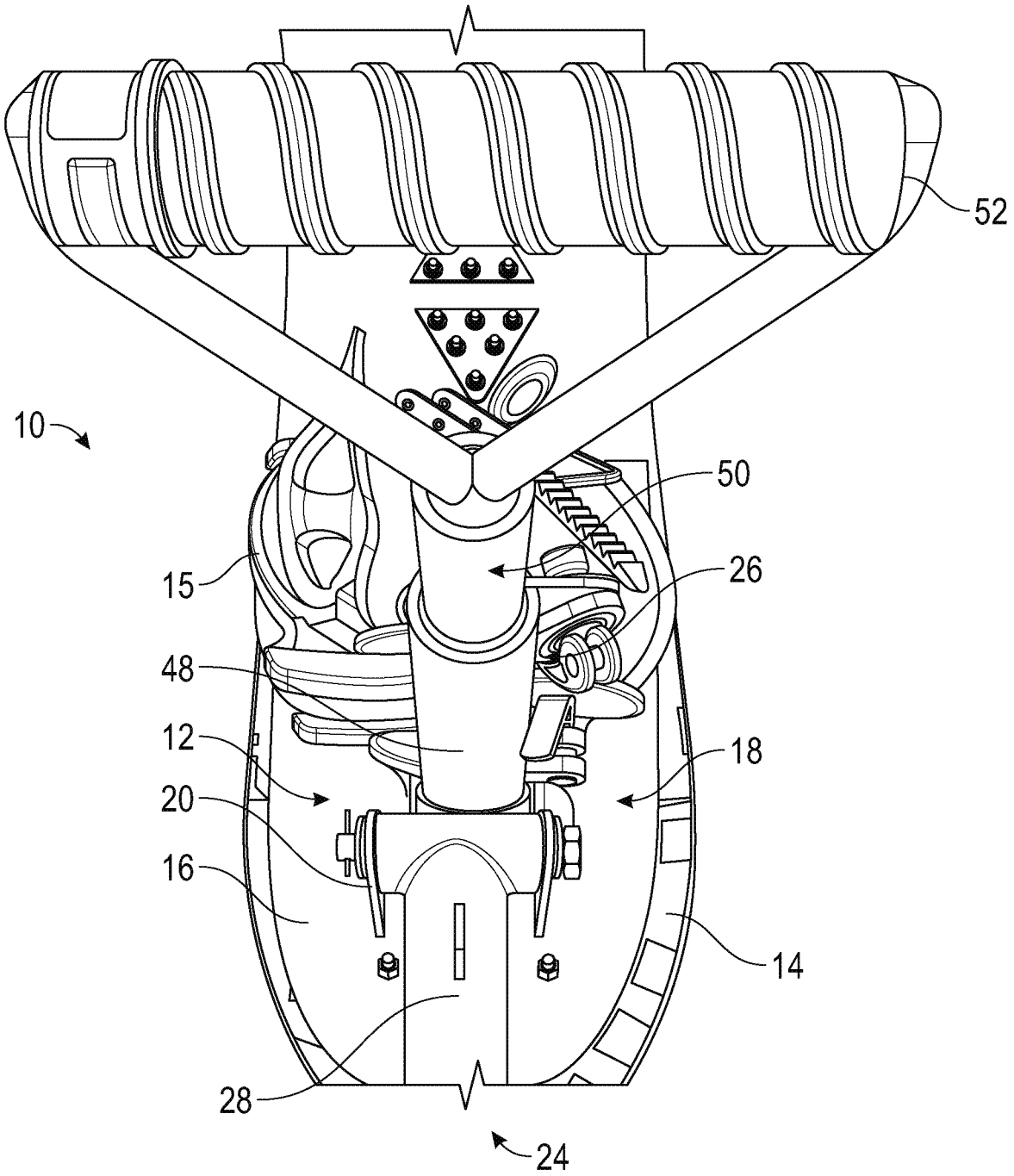
FIG. 2 is a top view of the trainer snowboard depicted in FIG. 1 with a more detailed view of a base plate, a guide handle assembly, and a rider handle assembly that forms a part of the training device according to an embodiment of the invention.
Figure 3:
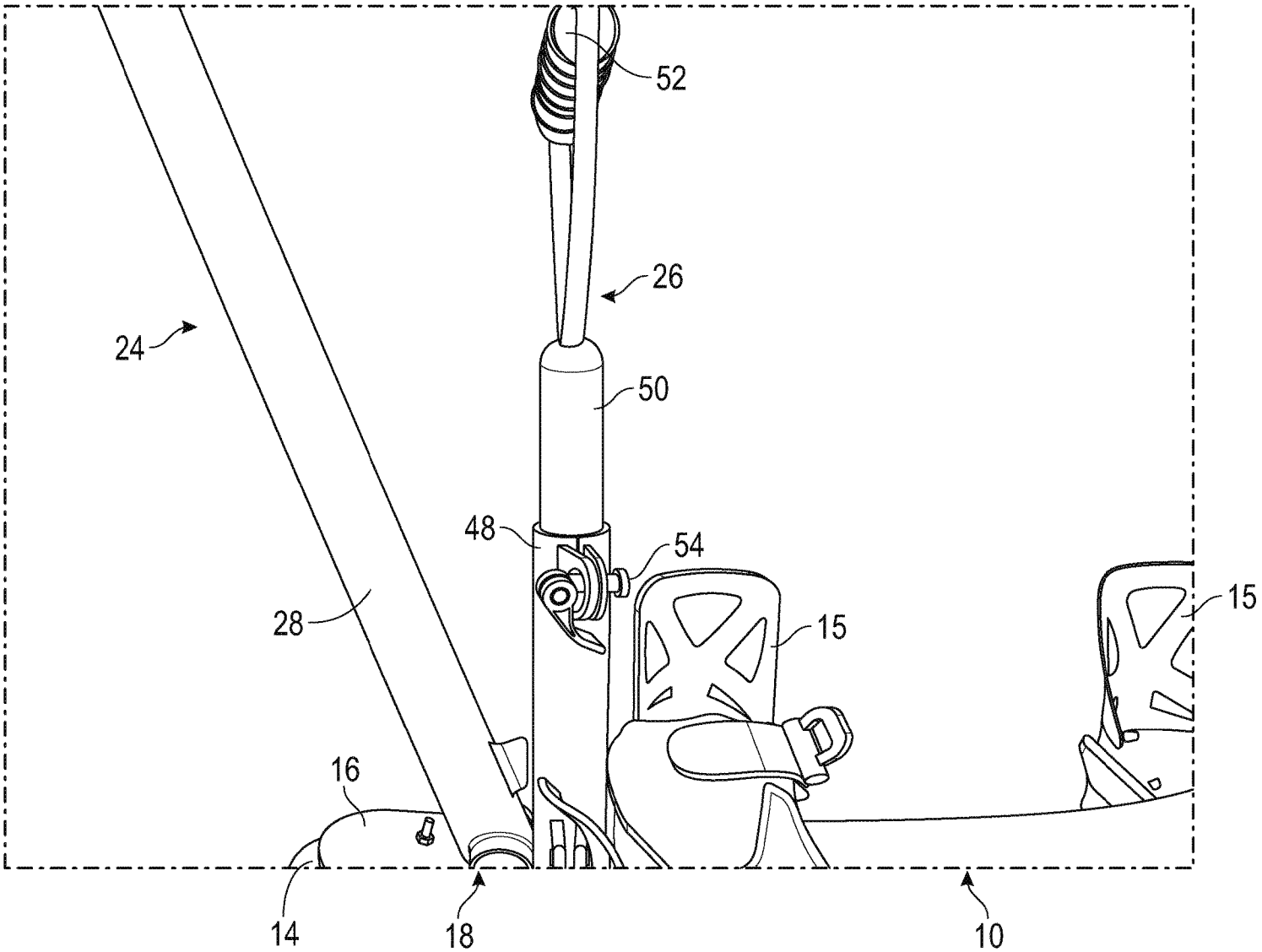
FIG. 3 is a side view of the trainer snowboard depicted in FIG. 1 with a more detailed view of the base plate, the guide handle assembly, and the rider handle assembly of the training device in relation to snowboard bindings of the trainer snowboard according to an embodiment of the invention.

Turning now to the figures, FIGS. 1-3 show various views of a trainer snowboard 10 with a training device 12 installed thereon according to an embodiment of the invention. As shown in FIGS. 1-3, the trainer snowboard 10 can include an elongated board 14 having a first end, a second end, a top and a bottom, a left side periphery and a right side periphery that is configured to be operated by a rider in a standing position. The elongated board can have a longitudinal axis that extends between its first and second ends. In general, the board 14 is straight along a majority of its longitudinal axis between the first and second ends. The board top can have a surface on which a rider may stand between the first and second ends. The board bottom can have a low-friction surface for sliding on a snowy surface. In addition, the trainer snowboard can include a pair of snowboard bindings 15 mounted to the board 14.

Figure 5:
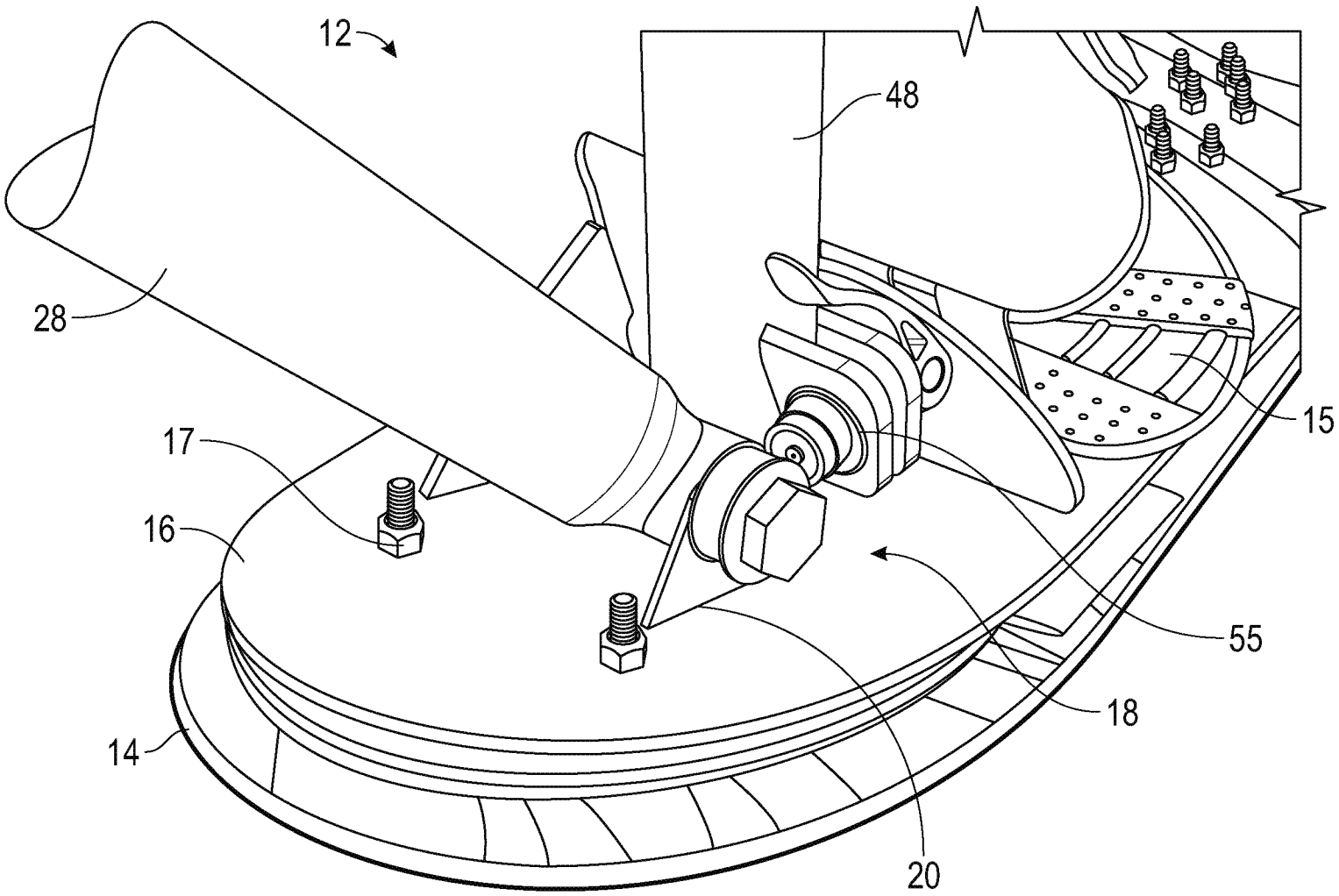
FIG. 5 is a front perspective view of the trainer snowboard depicted in FIG. 1 with a more detailed view of the base plate, the guide handle assembly, and the rider handle assembly of the training device according to an embodiment of the invention.
Figure 6:
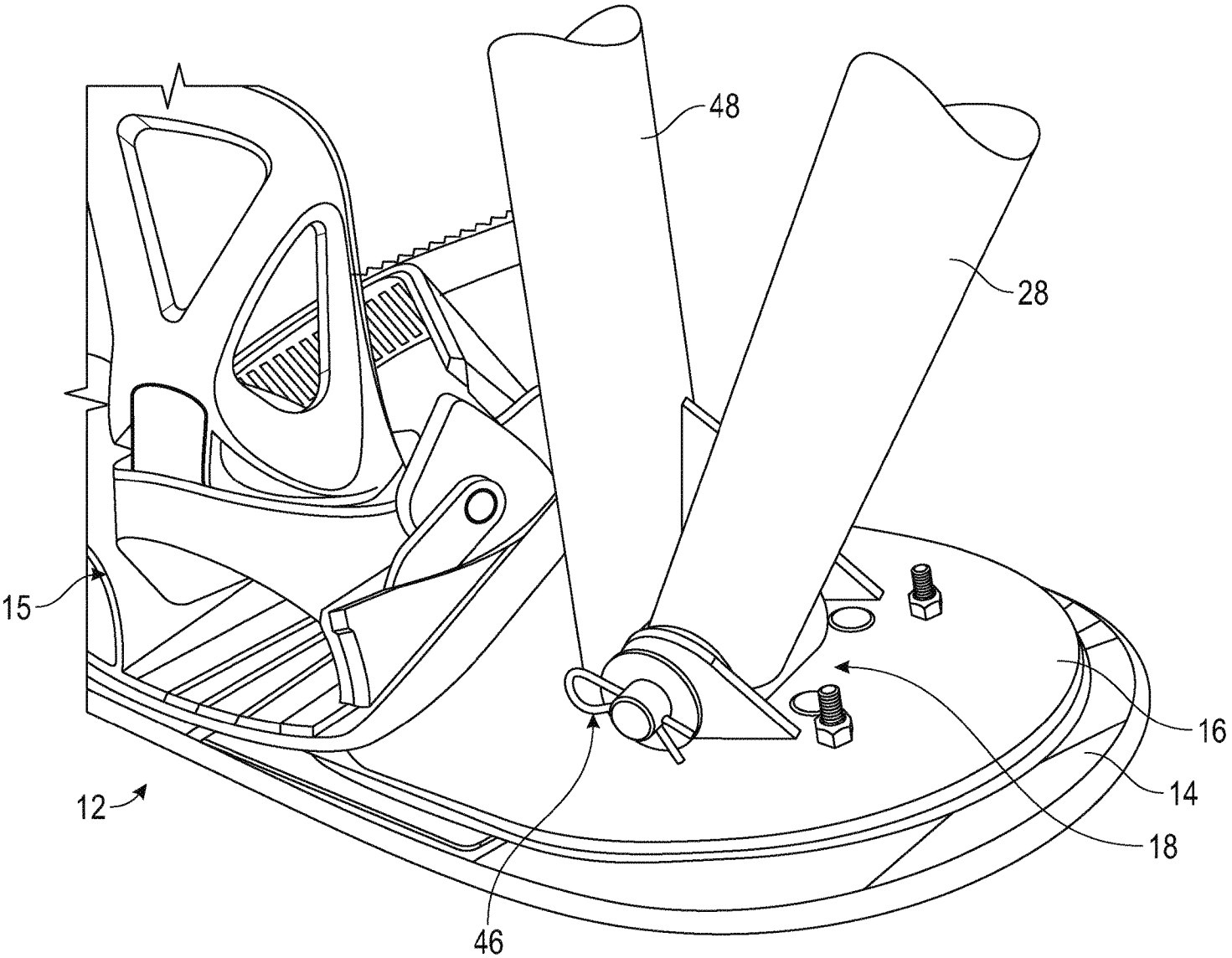
FIG. 6 is a frontal side, perspective view of the trainer snowboard depicted from an opposing side of that depicted in FIG. 5 according to an embodiment of the invention.
Figure 7:
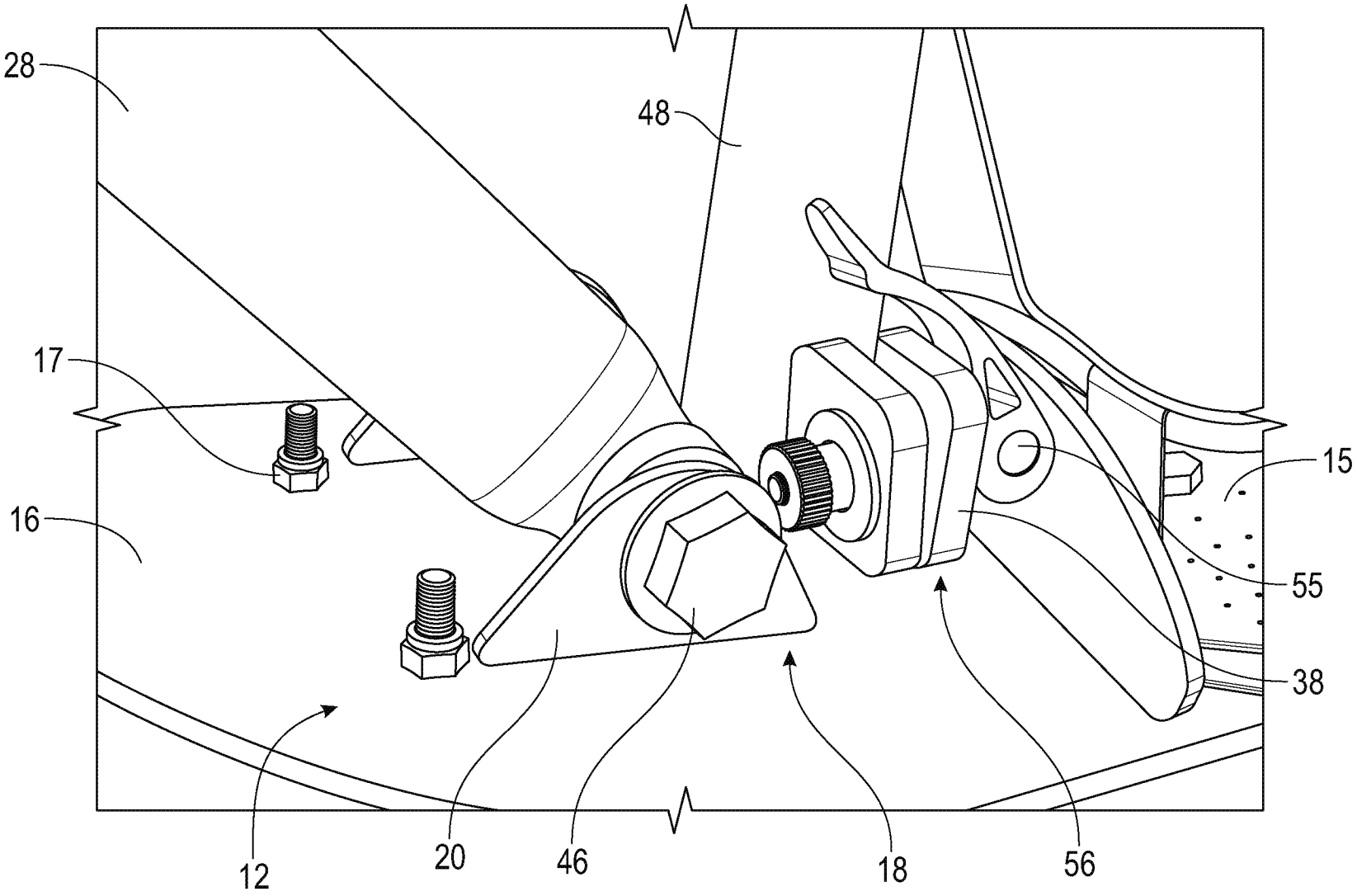
FIG. 7 is a perspective detailed view of the trainer snowboard depicted in FIG. 1 with a more detailed view of a handle support assembly that forms a part of the training device according to an embodiment of the invention.

The training device 12 can include a base plate 16 adapted for mounting on the surface of the top of the board 14 about the first end. The base plate 16 can have a handle support assembly 18 configured to secure at least one handle assembly thereto. The handle support assembly 18 can include a first flange structure 20 and a second flange structure 22 adjacent the first flange structure. In one embodiment, as shown in FIGS. 5-7, a plurality of base plate fasteners 17 can be configured to secure the base plate 16 to the upper surface of the board 14. To this extent, a first of the pair of snowboard bindings 15 can be mounted proximate the first end on the base plate 16 and a second of the pair of snowboard bindings can be mounted on the board top surface proximate the second end.

As shown in FIGS. 1-3, the training device 12 can include a height-adjustable guide handle assembly 24 that is removably attachable with the first flange structure 20. To this extent, the guide handle assembly 24 allows a guide to control the speed and the direction of the board 14 while operated by the rider. In one embodiment, a location of attachment of the guide handle assembly 24 with the first flange structure 20 creates a fulcrum point for the guide handle assembly to rotate thereabout while the guide controls the speed and the direction of the rider on the board 14. With this feature, the guide handle assembly 24 can serve as an active post (due to the fulcrum point) that allows the guide to provide a free-flowing ride to the rider over flat surfaces and through surfaces with elevation changes. This allows the rider to have edge control of the board 14 over varying surfaces at the left side periphery and the right side periphery. In this manner, the rider will experience a fluid and independent feel on the board while being guided by the guide with the use of the guide handle assembly 24. This feature is especially helpful during elevation changes since the active guide handle assembly enables the action of the guide handle assembly to absorb any bumps that are encountered during these changes as opposed to the guide. In this manner, the active handle assembly ensures that the rider will always have edge control on both edges of the board 14. If the guide handle was fixed on the board 14, then the rider could easily have the nose of the board lift from too much down pressure, which then takes away the edge control.

In addition to the guide handle assembly 24, the training device 12 can include a height-adjustable rider handle assembly 26 that is removably attachable with the second flange structure 22. In operation, the rider handle assembly 26 is configured to be held by the rider for balance while supported on the board 14 including instances when guided by the guide and instances without any assistance from the guide.

Further details of the guide handle assembly 24 are shown in FIGS. 1-4. As shown in these figures, the guide handle assembly 24 can include an elongated lower support guide member 28 that is removably attachable with the first flange structure 20. An elongated upper support guide member 30 can be configured to be received by the lower support guide member 28. In one embodiment, the upper support guide member 30 can be slid into and fixed with the lower support guide member 28. The guide handle assembly 24 can further include a guide handle bar 32 mounted on an upper end of the upper support guide member 30. In one embodiment, the upper support rider member 50 and the rider handle bar 52 are telescopically arranged in relation to the lower support rider member 48 for providing height adjustment of the guide handle assembly 24.

Figure 8:
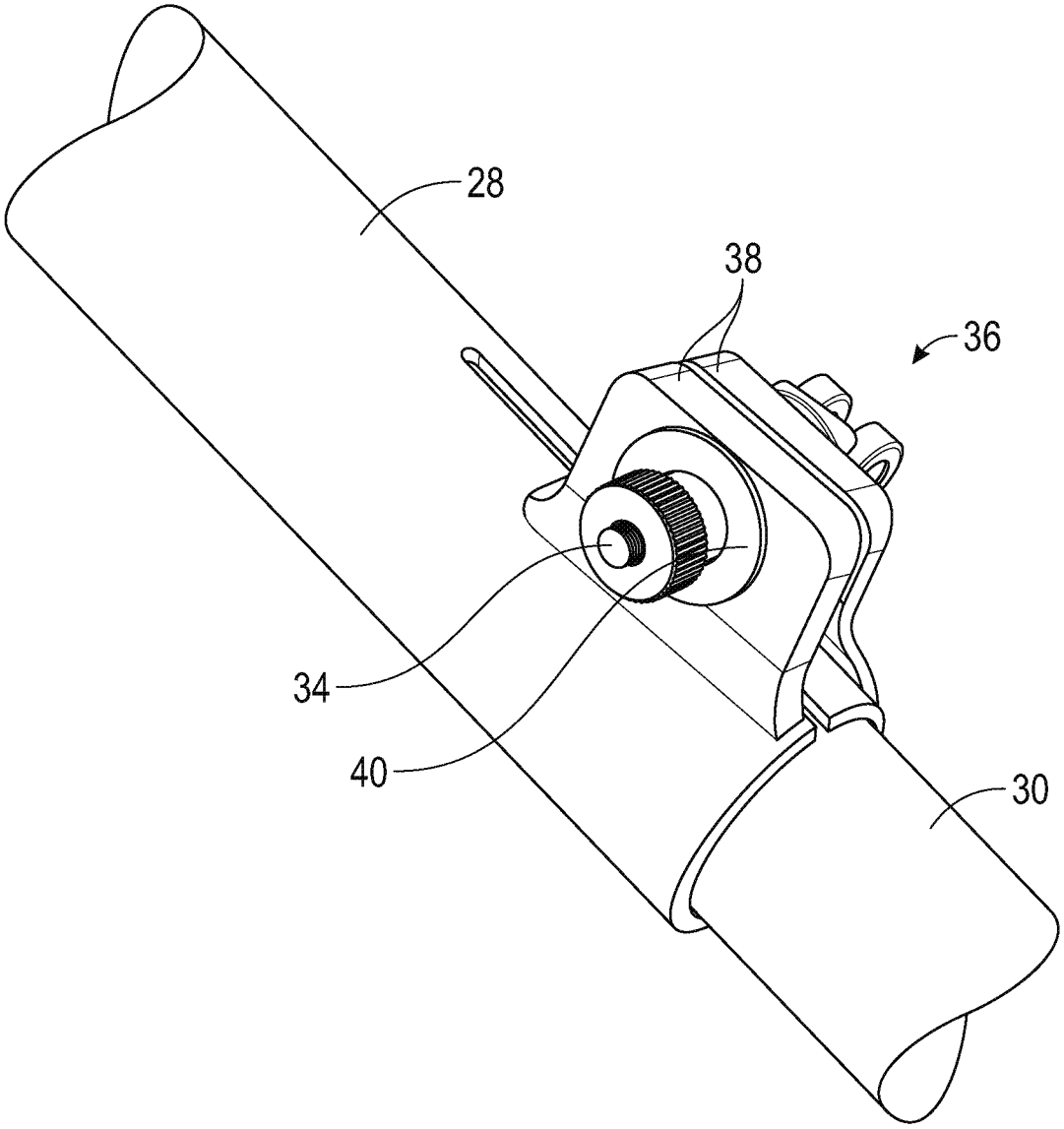
FIG. 8 is a perspective detailed view of one of the handle assemblies of the training device with clamping brackets and a fastener according to an embodiment of the invention.

As shown in FIG. 8, a guide handle assembly upper fastener 34 can be configured to secure the upper support guide member 30 and the guide handle bar 32 (not shown in FIG. 8) with the lower support guide member 28. FIG. 8 also shows that the guide handle assembly upper fastener 34 can operate cooperatively with an integrated guide clamping mechanism 36. The integrated guide clamping mechanism 36 can be formed on one of the upper support guide member 30 and the lower support guide member 28. As shown in FIG. 8. the guide clamping mechanism 36 can include a pair of parallel-spaced clamping brackets 38. Each clamping bracket can have an opening 40 formed therethrough. To this extent, the opening 40 in a first of the pair of parallel-spaced clamping brackets 38 can be in alignment with the opening in a second of the pair of parallel-spaced clamping brackets. In one embodiment, the guide handle assembly upper fastener 34 can be operatively coupled to the pair of parallel-spaced clamping brackets 38 via the openings 40. In this manner, opening and closing the guide handle assembly upper fastener 34 allows the upper support guide member 30 and the guide handle bar 32 to be secured and unsecured with the lower support guide member 28. In one embodiment, the guide handle assembly upper fastener can include, but are not limited to a quick-release mechanism (e.g., a quick-release lever or pin), a screw, a bolt, and a pin.

FIGS. 2 and 4-7 show that, in embodiments, the lower support guide member 28 can include a pair of opposing protrusion members 42 extending transversely outward from a lower end of the lower support guide member. In operation, the protrusion members 42 are configured to be attached to the first flange structure 20. In one embodiment, each of the pair of protrusion members 42 can have openings 44 that extend therethrough and into the lower end of the lower support guide member 28. To this extent, the openings 44 in the pair of protrusion members 42 that extend into the lower end of the lower support guide member 28 are in alignment. In one embodiment, a guide handle assembly lower fastener 46 can be operatively coupled to the openings 44 in the pair of protrusion members 42. In this manner, the guide handle assembly fastener 46 is configured to secure the lower end of the lower support guide member 28 to the first flange structure 20, creating the fulcrum point for the guide handle assembly 24 to rotate thereabout. In one embodiment, the guide handle assembly upper fastener 46 can include, but are not limited to a quick-release mechanism (e.g., a quick-release lever or pin), a screw, a bolt, and a pin.

As noted above, one feature associated with the guide handle assembly 24 is that a guide can use the active handle assembly to provide a free-flowing ride to the rider over a variety of surfaces. The guide handle assembly 24 can be configured with other features that further facilitate the aspect of providing a free-flowing ride. In one embodiment, a bump stop can be configured about the lower support guide member 28. To this extent, the bump stop can prevent the guide handle assembly 24 from impacting the rider's hand or the rider handle assembly 26 while the guide uses the guide handle assembly to control the speed and the direction of the sliding board 14 while operated by the rider (e.g., during pushes on level ground).

Further details of the rider handle assembly 26 are shown in FIGS. 1-4. As shown in these figures, the rider handle assembly 26 can include an elongated lower support rider member 48 that is removably attachable with the second flange structure 22. An elongated upper support rider member 50 can be configured to be received by the lower support rider member 48. In one embodiment, the upper support rider member 50 can be slid into and fixed with the lower support rider member 48. The rider handle assembly 26 can further include a rider handle bar 52 mounted on an upper end of the upper support rider member 50. In one embodiment, the upper support rider member 50 and the rider handle bar 52 are telescopically arranged in relation to the lower support rider member 48 for providing height adjustment of the rider handle assembly 26.

Figure 9:
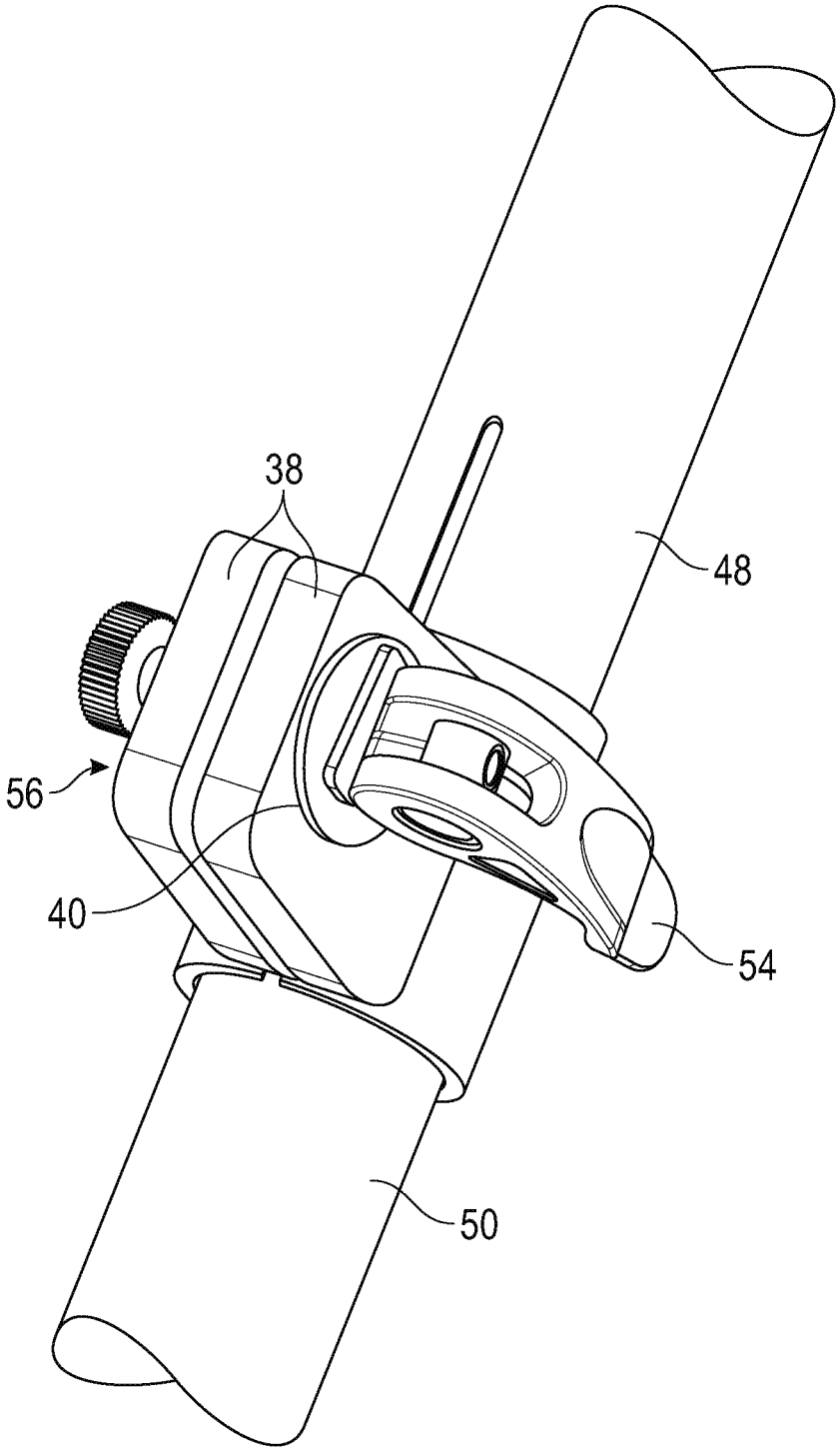
FIG. 9 is a perspective detailed view of another one of the handle assemblies of the training device with clamping brackets and a fastener according to an embodiment of the invention.

As shown in FIG. 9, in an embodiment, a guide handle assembly upper fastener 54 can be configured to secure the upper support guide member 50 and the guide handle bar 32 (not shown in FIG. 9) with the lower support guide member 48. FIG. 9 also shows that the guide handle assembly upper fastener 54 can operate cooperatively with an integrated guide clamping mechanism 56. The integrated guide clamping mechanism 56 can be formed on one of the upper support guide member 50 and the lower support guide member 48. As shown in FIG. 9. the guide clamping mechanism 56 can include a pair of parallel-spaced clamping brackets 38. Each clamping bracket can have an opening 40 formed therethrough. To this extent, the opening 40 in a first of the pair of parallel-spaced clamping brackets 38 can be in alignment with the opening in a second of the pair of parallel-spaced clamping brackets. In one embodiment, the guide handle assembly upper fastener 54 can be operatively coupled to the pair of parallel-spaced clamping brackets 38 via the openings 40. In this manner, opening and closing of the guide handle fastener 54 allows the upper support guide member 50 and the guide handle bar 32 to be secured and unsecured with the lower support guide member 48.

Figure 4:
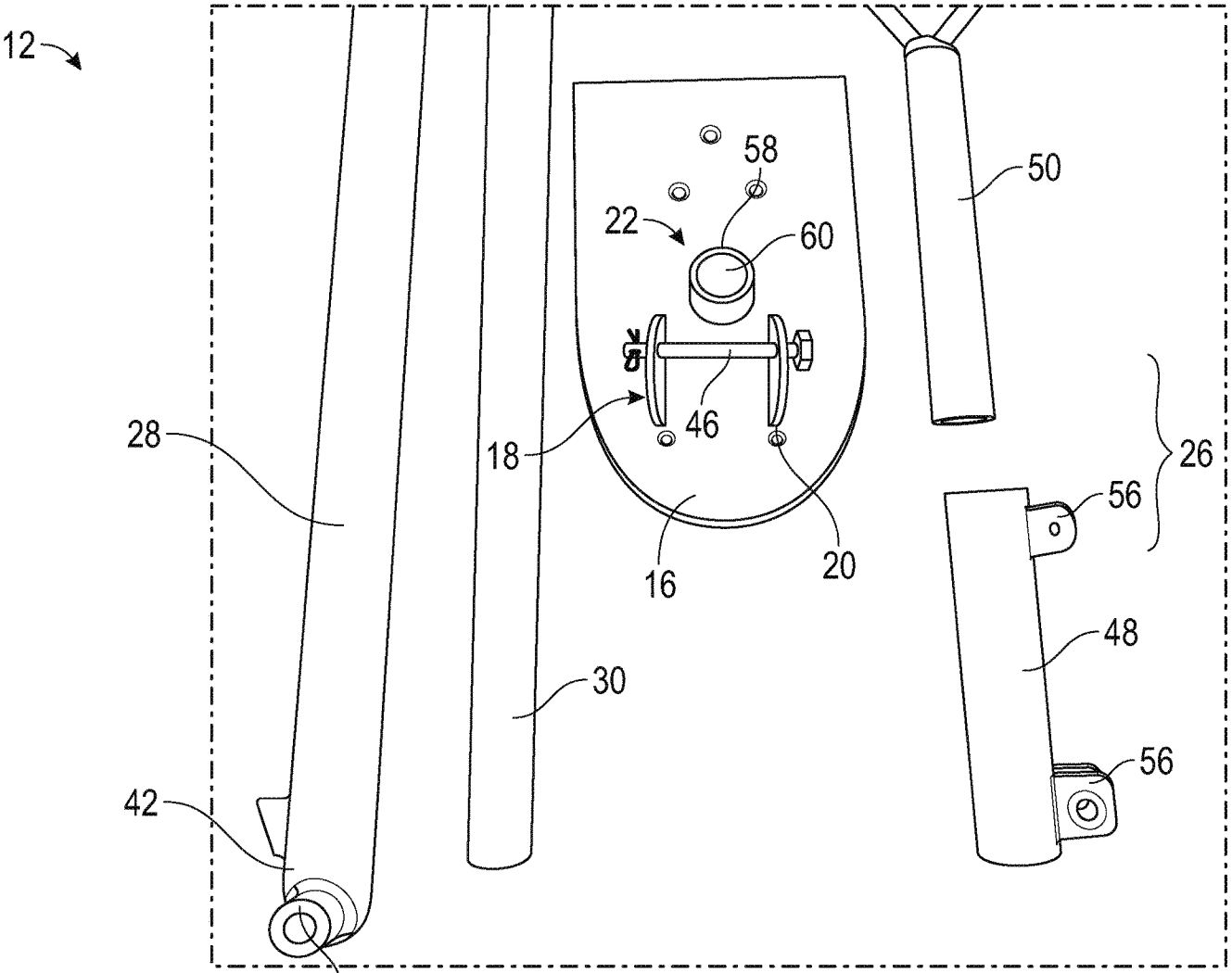
FIG. 4 is a top view of a kit of parts of the training device for assembling as a training device for use with the trainer snowboard according to an embodiment of the invention.

As shown in FIGS. 4, 5 and 7, in embodiments, a lower end of the lower support rider member 48 can also have an integrated rider clamping mechanism 56. Similarly, the rider clamping mechanism 56 can include a pair of parallel-spaced clamping brackets 38 with openings 40 formed therethrough. A rider handle assembly lower fastener 55 can operate cooperatively with an integrated rider clamping mechanism 56 at the lower end of the lower support rider member 48 to secure the lower support rider member 48 to the second flange structure 22. In one embodiment, as shown in FIG. 4, the second flange structure 22 can include a socket member 58 that defines a socket with an opening 60 to receive and fix the rider handle assembly 26 therein. In this manner, once the lower support rider member 48 of the rider handle assembly 26 is inserted and fixed in the socket opening 60 in the socket member 58, then the rider handle assembly lower fastener 55 located thereabout can be used to secure the connection of the lower support rider member to the second flange structure 22. Similarly, opening the rider handle assembly lower fastener 55 enables the lower support rider member 48, and thus the rider handle assembly 26, to be removed from the second flange structure 22 and the base plate 16.

Although the description heretofore has been generally directed to a training device and trainer snowboard that is configured with the training device, another embodiment of the present invention can include a kit of parts for assembling the training device 12 for use with the trainer snowboard 10. The kit of parts can include the components that an end user can assemble at a time of use to yield the trainer snowboard 10. In one embodiment, the kit of parts for assembling training device 12 may include a base plate adapted for mounting on a top surface of a snowboard, the base plate having a handle support assembly configured to secure at least one handle assembly thereto, wherein the handle support assembly includes a first flange structure and a second flange structure adjacent the first flange structure; a height-adjustable guide handle assembly removably attachable with the first flange structure that allows a guide to control speed and direction of the snowboard while operated by a rider, wherein a location of attachment of the guide handle assembly with the first flange structure creates a fulcrum point for the guide handle assembly to rotate thereabout while the guide controls the speed and the direction of the snowboard to provide a free-flowing ride to the rider through elevation changes, allowing the rider to have edge control of the snowboard; and a height-adjustable rider handle assembly removably attachable with the second flange structure configured to be held by the rider for balance while supported on the snowboard including instances when guided by the guide and instances without any assistance from the guide.

In light of the various embodiments described herein, it should be apparent that the training device 12 and trainer snowboard 10 configured with the training device have several features and technical effects that can include many advantages over prior approaches and devices used to instruct and guide beginners in developing their skill in a wide variety of boardsports.

One of these features include stability and balance. In particular, the training device of the various embodiments provides an extra level of stability and balance to beginners, helping them feel more secure on a boardsport such as a snowboard. This can reduce the fear of falling and make the learning process less intimidating.

Gradual progression for developing skills is another benefit of the various embodiments. In particular, by offering adjustable and removable handles, the training device of the embodiments allow users to start with a higher level of assistance and gradually reduce it as they become more confident and skilled. This progressive approach promotes a smoother transition to riding independently.

Another benefit includes safety. In particular, the various embodiments offer the potential for an experienced person to guide and assist the rider from behind. This guidance can prevent accidents, especially for beginners navigating unfamiliar terrain.

In one of the embodiments, the various fasteners noted above can utilize a quick-release mechanism that allows the training device and the trainer snowboard to be easily configured and reconfigured as the user progresses in developing their skills and comfort in stability and balance. For example, the quick-release fastener facilitates easy attachment/detachment or adjustment of the guide handle assembly and the rider handle assembly as the user's stability, balance and skills progress. In this manner, the guide handle assembly can be removed as the user becomes comfortable riding without the guide. Similarly, the rider handle assembly can be disassembled as the rider's stability and balance is sufficient to ride without the rider handle assembly.

Another benefit of the training device and the trainer snowboard is that no modifications are required to existing snowboards to make a trainer snowboard. In particular, the training device can be attached to an existing snowboard without requiring any modifications. This preserves the integrity of the original equipment and allows riders to switch between using the training device and riding independently.

The training device and the trainer snowboard of the various embodiments are advantageous in that it facilitates collaborative learning. In particular, the involvement of another person to control speed and assist in steering creates a collaborative learning environment. This can enhance the learning experience and create a sense of camaraderie between the rider and their guide.

Elevation adaptability is another feature associated with the training device and the trainer snowboard. As noted above, the use of the guide handle assembly can provide a free-flowing ride to the rider especially during elevation changes. In this manner, the use of the guide handle assembly can accommodate the natural dynamics of snowboarding. This ensures that the rider experiences a realistic and adaptable learning environment.

Another benefit to the training device and the trainer snowboard is that it promotes rider independence and facilitates the ultimate goal of helping riders become proficient enough to ride without assistance. The training device and the trainer snowboard facilitate this goal by allowing users to gradually reduce their reliance on the training device and trainer snowboard as their skills improve.

Yet another advantage of the training device and the trainer snowboard is that it can provide a customizable experience. That is, the height of the handles of the guide handle assembly and the rider handle assembly lets users customize the training device to their comfort level and preferences, enhancing the overall experience.

The invention claimed is:

1. A training device for use with a sliding board, comprising:

a base plate adapted for mounting on an upper surface of the sliding board, the base plate having a handle support assembly configured to secure at least one handle assembly thereto, wherein the handle support assembly includes a first flange structure and a second flange structure adjacent the first flange structure;

a height-adjustable guide handle assembly removably attachable with the first flange structure configured to allow external control of the speed and direction of the sliding board while operated by a rider, wherein a location of attachment of the guide handle assembly with the first flange structure creates a fulcrum point for the guide handle assembly to rotate thereabout during external control of the speed and direction of the sliding board to provide a free-flowing ride to the rider; and a height-adjustable rider handle assembly removably attachable with the second flange structure configured to be held by the rider for balance while supported on the sliding board including instances when externally guided and instances without any external guidance.

2. The training device of claim 1 further comprising:

an elongated board removably secured to the base plate.

3. The training device of claim 2 wherein the elongated board further comprises:

a pair of snowboard bindings mounted to the board.

4. The training device of claim 2 wherein the elongated board has a bottom with a low-friction surface for sliding on a snow-covered surface.

5. A trainer snowboard, comprising:

an elongated board having a first end, a second end, a top and a bottom, a left side periphery and a right side periphery, the elongated board having a longitudinal axis between its first and second ends, the board being generally straight along a majority of its longitudinal axis between the first and second ends, the board top having a surface on which a rider may stand between the first and second ends, and the board bottom being a low-friction surface for sliding on a snowy surface;

a base plate adapted for mounting on the surface of the board top about the first end, the base plate having a handle support assembly configured to secure at least one handle assembly thereto, wherein the handle support assembly includes a first flange structure and a second flange structure adjacent the first flange structure;

a height-adjustable guide handle assembly removably attachable with the first flange structure that is configured to allow a guide to externally control speed and direction of the board while operated by the rider, wherein a location of attachment of the guide handle assembly with the first flange structure creates a fulcrum point for the guide handle assembly to rotate thereabout while the guide controls the speed and the direction of the board to provide a free-flowing ride to the rider over flat surfaces and through surfaces with elevation changes, allowing the rider to have edge control of the board over varying surfaces at the left side periphery and the right side periphery; and a height-adjustable rider handle assembly removably attachable with the second flange structure configured to be held by the rider for balance while supported on the board including instances when externally guided and instances without any external guidance.

6. A kit of parts for assembling a trainer snowboard, comprising:

a base plate adapted for mounting on a top surface of a snowboard, the base plate having a handle support assembly configured to secure at least one handle assembly thereto, wherein the handle support assembly includes a first flange structure and a second flange structure adjacent the first flange structure;

a height-adjustable guide handle assembly removably attachable with the first flange structure that is configured to allow a guide to control speed and direction of the snowboard while operated by a rider, wherein a location of attachment of the guide handle assembly with the first flange structure creates a fulcrum point for the guide handle assembly to rotate thereabout allowing for control of the speed and the direction of the snowboard to provide a free-flowing ride to the rider through elevation changes, allowing the rider to have edge control of the snowboard; and a height-adjustable rider handle assembly removably attachable with the second flange structure configured to be held by the rider for balance while supported on the snowboard including instances when guided by the guide and instances without any assistance from the guide.

7. The kit of parts of claim 6 further comprising:

a snowboard configured for removable attachment to the base plate.

8. The kit of parts of claim 7 wherein the snowboard further comprises:

a pair of bindings mounted to the snowboard.

9. The kit of parts of claim 7 wherein the snowboard has a bottom with a low-friction surface for sliding on a snow-covered surface.

* * * * *